United States Patent [19]

Arsac

[11] 3,983,286

[45] Sept. 28, 1976

[54] METHOD OF FIXING COPPER SALTS TO ARTICLES OF SYNTHETIC POLYMERS

[75] Inventor: Andre Arsac, Millery, Vernaison, France

[73] Assignee: Rhone-Poulenc-Textile, France

[22] Filed: Mar. 4, 1975

[21] Appl. No.: 555,253

Related U.S. Application Data

[63] Continuation-in-part of Ser. No. 353,730, April 20, 1973, Pat. No. 3,940,533.

[30] Foreign Application Priority Data

Mar. 18, 1974 France ..... 74.09384

[52] U.S. Cl. ..... 428/225; 427/125; 427/301; 427/304; 427/322; 427/323; 427/430; 428/389; 428/395

[51] Int. Cl.[2] ..... D04B 1/00; B05D 5/12

[58] Field of Search ..... 106/1; 427/125, 301, 427/304, 322, 323, 430; 428/225, 389, 395

[56] References Cited

UNITED STATES PATENTS

| | | | |
|---|---|---|---|
| 3,296,013 | 1/1967 | Foeley | 427/304 |
| 3,650,803 | 3/1972 | Lin | 428/462 |

FOREIGN PATENTS OR APPLICATIONS

| | | | |
|---|---|---|---|
| 508,206 | 9/1930 | Germany | 427/304 |

*Primary Examiner*—Michael R. Lusignan
*Attorney, Agent, or Firm*—Stevens, Davis, Miller & Mosher

[57] ABSTRACT

The invention relates to a method of fixing copper salts on articles of synthetic polymers such as described in copending U.S. Pat. application Ser. No. 353,730 filed Apr. 20, 1973, now U.S. Pat. No. 3,940,533, patented Feb. 24, 1976; it also concerns articles and particularly, textile articles which have been obtained by the process as well as all materials containing them.

The process involves subjecting the articles to the action of hydrogen sulfide and then to the action of a copper salt, characterized by the fact that the treatment with the copper salt is carried out in the presence of polyphenol.

The articles obtained may be used, because of their good antistatic properties, to the manufacture of floor or wall coverings and, because of their good conductivity, to the manufacture of heating articles (partitions, clothes, industrial heating articles, etc.).

11 Claims, No Drawings

METHOD OF FIXING COPPER SALTS TO ARTICLES OF SYNTHETIC POLYMERS

The present invention relates to an improvement in the method of fixing copper salts on articles of synthetic polymers, such as described in copending U.S. Pat. application Ser. No. 353,730 filed Apr. 20, 1973, now U.S. Pat. No. 3,940,533, patented Feb. 24, 1976, application is a continuation-in-part.

In the aforesaid application, a method is described of fixing metallic compounds on articles of synthetic polymers which makes it possible to increase the electrical conductivity of these articles.

In accordance with this method, the articles are subjected to the action of hydrogen sulfide under pressure or the action of an aqueous solution of a sulfur compound containing a reactive sulfur atom without a positive gage pressure and then subjecting them to the action of an aqueous solution of a metallic salt. The process is particularly well suited for the production of antistatic articles such as floor or wall coverings as well as conductive fabrics useful as heating surfaces.

It has now been found, and this constitutes an object of the present invention, that in the specific case of the treatment of the article by hydrogen sulfide under pressure and then by a solution of copper salt, the method can be improved so as to permit greater adherence of the copper salts to the treated article.

The present invention provides an improvement in the method of fixing copper salts on articles of synthetic polymers in which the articles are subjected to the action of hydrogen sulfide and then to the action of a copper salt in accordance with the process described in the aforesaid application, characterized by the fact that the treatment with the copper salt is carried out in the presence of polyphenol.

The invention also provides articles treated by the process as well as all articles containing at least 0.05 percent by weight of at least one of the articles treated in accordance with the invention.

The articles adapted for treatment in accordance with the process of the invention are generally textile materials which may be present in very different forms such as fibers, yarns, filaments, threads or shaped articles such as woven fabrics, knitted fabrics, nonwovens or any materials containing them. The textile materials may be formed of synthetic polymers such as, for instance, polyamides (polyhexamethalyene adipamide, polycaproamide), polyesters (ethylene glycol polyterephthalate or propane diol polyterephthalate), thermostable polymers of the polyamide-imide type, aromatic polyamides, etc., or mixtures of these polymers.

As in the aforesaid patent application, the article is treated with hydrogen sulfide under pressure, preferably a gage pressure of at least about 2 kg. per square centimeter in gaseous or liquid phase, for instance, in an autoclave brought to the saturating vapor pressure; it is then immersed in an aqueous solution of a copper salt such as the chloride but preferably the sulfate or nitrate, at a temperature between 15° and 80°C for a period of time which may vary between one-half hour and two hours. The most preferred impregnation pressure is from 2 to 5 kg. per square centimeter but any positive gage pressure may be used.

In accordance with the present invention, the treatment with the copper salt is carried out in the presence of an agent capable of swelling the treated material and of creating bonds between the material and the metallic components which it is desired to fix.

It has been found that the polyphenols satisfy these conditions. As polyphenols which are suitable for carrying out the process of the invention, mention may be made of orthodiphenol, metadiphenol, and paradiphenol, 1,3,5-trihydroxy benzene or any other suitable polyphenol substance such as the tannins. The polyphenol can be applied to the article in the following manner, namely either by effecting a pretreatment with the polyphenol before the treatment with the hydrogen sulfide and the copper salt or by introducing the polyphenol into the aqueous solution of copper salt with a concentration of at least 0.1 percent by weight and preferably between 3 and 6 percent. The article is then rinsed with water, centrifuged and dried by any suitable known means. It may be pointed out that the process can also be used for fixing silver salts; however, in this case the results are less valuable since the adherence of the silver salts fixed in accordance with the process of the aforesaid application is generally sufficient; furthermore, it is preferred from an economic standpoint to employ copper salts.

The article treated in accordance with the process of the invention shows an increase in weight which is generally between 2 to 10 percent. This increase is due to a uniform regular continuous surface deposit of copper salts whose thickness may vary between 0.01 and 0.5$\mu$, depending on the treatment conditions. It has been found by conventional methods of analysis by x-ray diffraction that this deposit consists essentially of cuprous sulfide and cupric sulfide. The adherence of the deposit is greater than that obtained by the process of my earlier application. The same is true of the electrical conductivity and the antistatic properties, which duly withstand dyeing, washing, dry-cleaning or similar treatments.

The textile article treated by the process of the present invention may be used by itself, but in most cases it forms part of the composition of untreated textile articles such as floor or wall coverings, articles of clothing, etc., in order to improve their antistatic properties or make them sufficiently conductive so as to use them as heating articles. It is then preferably introduced, in the form of fibers, filaments or yarns, whether or not crimped, for instance, in the form of threads, into the cutter at the same time as a cable of untreated synthetic filaments, the mixed fibers obtained at the outlet of the cutter being then transformed into yarns, or into stitched coverings, or else the threads can be assembled or twisted with other untreated threads or yarns or else knitted or woven with other untreated threads or yarns.

The quantity of material which has been treated in accordance with the process of the invention which may be present in the composition of the untreated textile articles may vary depending on the effect desired. In general, it has been found that a quantity of at least 0.05 percent by weight is sufficient to produce a substantial improvement in the conductive properties of the treated article and therefore in its antistatic properties.

The following examples are given by way of illustration and not of limitation in order to clarify the invention:

EXAMPLE 1

Polyhexamethylene adipamide fibers of a size of 22 dtsx (20 denier), and a length of 75 mm, which had been previously desized, are introduced into an autoclave which is fed with hydrogen sulfide under a pressure of 3 bars at a temperature of 22°C. After one hours treatment, the fibers are immersed in an aqueous solution at 60°C containing 5 percent by weight copper sulfate and 5 percent by weight metadiphenol; they are rinsed with running water and dried in an oven at 60°C for 30 minutes. The increase in weight due to the treatment of the fibers is 4.2 percent.

The electrical conductivity of the fibers is measured in the following manner: a fiber is stretched between two electrodes which are located 4 cm apart, under an initial tension of 0.330 g and fed by means of a 20 volt cell. The current which passes through the fiber is measured by means of a galvanometer connected in series in the circuit and the resistance is deducted therefrom. Thereupon the same measurement is effected after the fibers have been subjected to dry cleaning with trichlorethylene for one quarter of an hour at 50°C, followed by drying in an oven at 60°C.

After 10 tests carried out on fibers treated under the same conditions, the results obtained are set forth in the following table as compared with those obtained with control fibers treated in the same manner except that the aqueous solution of copper sulfate does not contain metadiphenol:

| | Without dry cleaning | After dry cleaning |
|---|---|---|
| Control | 65 $10^3$ ohms | 92 $10^3$ ohms |
| Specimen treated with metadiphenol | 24 $10^3$ ohms | 29 $10^3$ ohms |

It is seen that the fibers treated in the presence of metadiphenol have better electrical conductivity than the fibers treated without metadiphenol and that, after drycleaning, the drop in the conductivity is only 20 percent in the case of the fibers treated in the presence of metadiphenol while it is 40 percent in the other case, which means a stronger adherence of the copper salts on the fibers.

The treated fibers have a deposit on their surface of copper salt of a thickness of 0.2 micron; they are incorporated in an amount of 0.2 percent for the manufacture of a needled nonwoven fabric with fibers of polyhexamethylene adipamide of 22 dtex (20 denier) of a length of 75 mm. Used as floor covering, the stitched nonwoven fabric obtained is antistatic and remains so even after several shampooings. This nonwoven fabric may also be used as tufted carpet backing.

The treatment has little effect on the dynamometric properties of the fibers, the ultimate strength of a treated fiber is 83 g for an elongation of 54 percent while that of an untreated control fiber is 73 g for an elongation of 58 percent, these measurements being carried out by means of an INSTRON dynamometer.

EXAMPLE 2

A nonwoven cloth or spun bonded type formed of continuous filaments of polyethyleneterephthalate, of 7.7 dtex (7 denier) weighing 300 g per $m^2$ is introduced into an autoclave fed with hydrogen sulfide under a pressure of 5 bars at a temperature of 22°C. After one hour of treatment the cloth is immersed for one hour at 60°C in an aqueous solution containing 5 percent copper sulfate and 13 percent orthodiphenol.

The electrical conductivity of the cloth is measured on a sample of a length of 20 cm by a width of 5 cm, without dry cleaning and after dry cleaning, under the same conditions as in Example 1. The results obtained are indicated in the following table as compared with those of an identical cloth treated under the same conditions except that the aqueous solution of cupric sulfate does not contain orthodiphenol:

| | Without cleaning | After cleaning |
|---|---|---|
| Control | 62 ohms | 200 ohms |
| Specimen treated with orthodiphenol | 23 ohms | 26 ohms |

It is seen that the conductivity of the cloth treated in the presence of orthodiphenol is superior to that of the control cloth and that its drop after cleaning is less (13 percent instead of 223 percent), which indicates much stronger adherence of the copper salts on the filaments of the cloth.

This nonwoven textile cloth is associated by stitching with another nonwoven cloth of the spun bonded type formed of continuous filaments of 7.7 dtex (7 denier) weighing 100 g/$m^2$ and is used as a heating wall covering; in addition, to the thermal and acoustic insulation it is noted that a uniform heat is liberated from the covering.

EXAMPLE 3

Fibers identical to those described in Example 1 are treated under the same conditions except that the metadiphenol is replaced by tannin ALS powder K marketed by the TRANSTANTIC Company.

The electrical conductivity of the fibers is measured in the same manner as in Example 1 except that the measurements carried out after dry cleaning are replaced by measurements effected after a dyeing carried out under the following conditions:

0.4 g of Neopolaire yellow 4 GL, marketed by CIBA-GEIGY, 1 g of a condensate of stearylamine and oleylamine with ethylene oxide, acetic acid q.s.p. pH 4, q.s.p. 1000 g of water with a bath ratio of 1 g of treated material to 100 g of bath.

The results obtained are indicated in the following table as compared with those obtained with control fibers treated under the same conditions except that the aqueous copper sulfate solution does not contain ALS tannin powder K.

| | Without dyeing | After dyeing |
|---|---|---|
| Control | 65 $10^3$ ohms | The current does not pass |
| Specimen treated with ALS tannin | 32 $10^3$ ohms | 28 $10^3$ ohms |

It is seen that the fibers treated in the presence of ALS tannin exhibit better conductivity than the fibers treated without ALS tannin and that the fibers remain conductive after dyeing, which is not true of the control fibers.

These treated fibers have a surface deposit of copper salt of a thickness of 0.3$\mu$; they enter into the manufacture of a fiber yarn by being introduced on the card at the rate of 0.03 percent jointly with polyhexamethylene adipamide fibers of 22 dtex (20 denier) of a length of 150 mm. The yarn obtained is used in a proportion of 1 thread for four, in the warp, of a tufted pile fabric.

EXAMPLE 4

A polyhexamethylene adipamide yarn of 17 dtex (15 denier) and of multilobular section which has been previously desized is treated by an aqueous metadiphenol solution of 10% by weight at 60°C for one hour, then rinsed with water at 40°C and dried at room temperature. This yarn is then treated in the same manner as in Example 1 except that the copper salt solution no longer contains metadiphenol. After treatment it has a surface deposit of copper salt of a thickness of 0.1 $\mu$; its mechanical properties, as compared with those of an untreated identical yarn, are as follows:

| Yarn | dtex | Ultimate strength | tenacity g/dtex | elongation % | Modulus g/dtex |
|---|---|---|---|---|---|
| Treated | 18.9 | 78.9 g | 41.7 | 32.65 | 119.8 |
| Control | 19.7 | 63.9 g | 32.6 | 56.8 | 95.8 |

Thereupon, the yarn is incorporated by means of a compressed air nozzle in a carpet yarn of 2300 dtex (2080 denier) /136 ends which has been textured by the process described in the U.S. Pat. No. 3,703,754 and the half-discharge time is measured with an electrometer ROTSCHILD as indicated in the U.S. Pat. application, Ser. No. 493,456.

Measurements are also made fiber dyeing this yarn in a bath containing:

0.19 g of a Nylosane EL yellow dyestuff marketed by SANDOZ (acid yellow 174)

0.09 g of a yellowish-brown dyestuff Nylosane ERL marketed by SANDOZ (acid brown 248), 0.019 g of a blue dyestuff Nylosane EGL marketed by SANDOZ (acid blue 72), 10 g of an anionic product Lyogene P marketed by SANDOZ, 30 g of an anionic product ERIONAL NWS marketed by CIBA-GEIGY, 1 cc of acetic acid in order to obtain a pH of 4, q.s.p. 1000 g of water with a bath ratio of 1 g of material to 50 cc of bath.

A second dyeing is then effected on an identical yarn under the same conditions but at a pH of 6 obtained by replacing the acetic acid with a buffer mixture composed of 2 g of monosodium phosphate crystallized with one molecule of water and 0.5 g of disodium phosphate crystallized with 12 molecules of water.

The measurements obtained are indicated in the following table as compared to those obtained with an identical control yarn which however had not undergone pretreatment with metadiphenol:

| | Before dyeing | After dyeing | |
|---|---|---|---|
| Control | Variable between 1 second and 25 min, | pH 3.8<br>pH 5.9 | 15 min.<br>15 min. |
| Specimen | Instantaneous discharge | pH 3.8<br>pH 5.9 | instantaneous discharge |

It is thus shown that the yarn pretreated with metadiphenol has good antistatic properties.

EXAMPLE 5

A nonwoven cloth is produced containing 99.9 percent by weight polyhexamethylene adipamide fibers of a size of 22 dtex (20 denier) and a length of 75 mm, dyed in the manner described in Example 3, and 0.1 percent of identical fibers which have not been dyed but have been treated as indicated in Example 1 in order to make them antistatic.

The cloth which is stitched weighs 400 g/m$^2$; it is stitched onto a support formed of a textile cloth made of natural fibers; the backside of the cloth is then coated with 150 g/m$^2$ of an acrylic resin containing 4 percent by weight of a product resulting from the condensation of fatty acids and marketed under the name of DUROSTAT by HANSAWERKE.

The stitched sandwich thus obtained is used as floor covering. Its antistatic properties are checked under the conditions described below.

The tests are carried out on samples after they have stayed for 48 hours in an enclosure at 22°C with a relative humidity of 40 percent.

a. DETERMINATION OF THE CROSS-RESISTANCE

The measurement is effected by means of a circuit containing, in series, a continuous generator discharging onto two electrodes between which the element whose cross-resistance is to be determined is placed, and an electrometer. The current is allowed to pass for 60 seconds under a voltage of 500 volts. The electrometer indicates a quantity of electricity from which the cross-resistance can be deduced.

b. DETERMINATION OF THE CHARGEABILITY

The sample resting on its back on a grounded metal plate is rapidly rubbed in customary fashion with a grounded metallic rubber; a guarded electrode connected to an electrometer is applied with a certain pressure against the sample. The value of the charge imparted by the rubbing of the sample is immediately read on the electrometer connected to the electrode.

c. DETERMINATION OF THE HALF-DISCHARGE TIME

The sample is charged under the conditions described above under b). An electrode connected to an electrometer is placed 1 cm from the front face of the sample. The time necessary for the value of the charge read on the electrometer to decrease by one-half as compared with its initial value determined at the moment of the putting in place of the electrode is noted.

d. WALKER TEST

The sample is applied over its entire length to a metal plate placed on the floor and grounded.

An operator, provided with shoes having leather soles, walks four steps over the carpet in an identical manners for each sample. When he has arrived at the end of the sample the operator touches with his finger an electrode connected to an electrometer. The charge imparted by the rubbing of his shoes on the sample is read from the electrometer which is connected to the electrode.

The same measurements are carried out on samples of a carpet identical to the one described above but containing 0.2 percent by weight of fibers treated in the manner set forth in Example 1 in order to make them antistatic.

The results (three measurements for each test) as compared with those obtained with a control carpet which was identical except that it does not contain antistatic fibers, are indicated in the following table (Table 1):

| Sample | Charge density coulomb × $10^{-12}$/ $cm^2$ | Half discharge time in seconds | Walker test coulomb × $10^{-7}$ | Cross-resistance in ohms |
|---|---|---|---|---|
| Control | 900 | 25 | 5 | $1.5 \cdot 10^{13}$ |
| | 1600 | 23 | 7 | $1.5 \cdot 10^{13}$ |
| | 2000 | 21 | 6.5 | $1.5 \cdot 10^{13}$ |
| 99.9% untreated fibers + 0.1% antistatic fibers | 250 | 3 | 1.5 | $5 \cdot 10^{11}$ |
| | 220 | 4 | 1.5 | $5 \cdot 10^{11}$ |
| | 180 | 5 | 1.3 | $5 \cdot 10^{11}$ |
| 99.8% untreated fibers + 0.2% antistatic fibers | 70 | 2 | 1.2 | $2.5 \cdot 10^{7}$ |
| | 140 | 2 | 0.7 | $1 \cdot 10^{7}$ |
| | 170 | 2 | 1.4 | $1 \cdot 10^{7}$ |

It is seen that the samples containing fibers treated in accordance with the process of the invention have antistatic properties which are far superior to those of the samples which do not contain any and that these properties are greater than the quantity of treated fibers.

EXAMPLE 6

The tests described in Example 5 are carried out on identical samples of floor coverings in which, however, at the time of coating the DUROSTAT contained in the acrylic resin was replaced by the same quantity of a similar product marketed under the name of TALLOPOL by the CHEMISCHE FABRIK STOCKHAUSEN.

As in Example 5, the results are indicated in the following table (Table 2):

| Sample | Charge density coulomb × $10^{-12}$/ $cm^2$ | Half discharge time in seconds | Walker test test × $10^{-7}$ | Cross-resistance in ohms |
|---|---|---|---|---|
| Control | 900 | 25 | 5 | $1.5 \cdot 10^{13}$ |
| | 1600 | 23 | 7 | $1.5 \cdot 10^{13}$ |
| | 2000 | 21 | 6.5 | $1.5 \cdot 10^{13}$ |
| 99.9% untreated fibers + 0.1% treated fibers | 300 | 7 | 2.7 | $2 \cdot 10^{12}$ |
| | 300 | 8 | 2.9 | $3 \cdot 10^{12}$ |
| | 350 | 8 | 3 | $5 \cdot 10^{11}$ |
| 99.8% untreated fibers + 0.2% treated fibers | 600 | 5 | 1.3 | $3 \cdot 10^{12}$ |
| | 700 | 6 | 1.4 | $9 \cdot 10^{11}$ |
| | 1000 | 5 | 1.4 | $1 \cdot 10^{12}$ |

As previously, it is seen that the antistatic properties are far superior in the case of the samples containing fibers treated by the process of the invention than in the case of the sample which does not contain any and that this improvement increases with the quantity of treated fibers introduced.

EXAMPLE 7

A nonwoven cloth is produced from a mixture formed of 60 percent by weight of dyed polyhexamethylene adipamide fibers of 22 dtex (20 denier) and a length of 75mm, and 40 percent by weight of polyethyleneterephthalates fibers, also dyed, of identical denier and length and into which there has been introduced 0.1 percent by weight, referred to the mixture of fibers, of polyhexamethylene adipamide of identical denier and length but not dyed and treated as in Example 1.

The cloth is stitched vertically and weighs 500 g/$m^2$. It is subjected on the backside to a first coating of 150 g/$m^2$ of butadiene-styrene latex containing 4 percent by weight DUROSTAT and then to a second coating of 400 g/$m^2$ of a cellular foam also containing 4 percent by weight DUROSTAT.

The floor covering thus obtained is subjected to the same tests as in Example 5; measurements are also carried out on samples of a carpet which are identical to that described above, but containing 0.2 percent of fibers treated in order to make them antistatic. The results obtained are indicated in the following table (Table 3):

| Sample | Charge density coulomb × $10^{-12}$/ $cm^2$ | Half discharge time in seconds | Walker test coulomb × $10^{-7}$ | Cross-resistance in ohms |
|---|---|---|---|---|
| Control | 1000 | 30 | 5 | $1.5 \cdot 10^{13}$ |

-continued

| Sample | Charge density coulomb × $10^{-12}$/ $cm^2$ | Half discharge time in seconds | Walker test coulomb × $10^{-7}$ | Cross-resistance in ohms |
|---|---|---|---|---|
| | 750 | 30 | 3.5 | $1.5 \cdot 10^{13}$ |
| | 700 | 30 | 4.5 | $1.5 \cdot 10^{13}$ |
| (60% polyamide fiber | 140 | 6 | 3 | $3.5 \cdot 10^{11}$ |
| (40% polyester fiber | 200 | 5 | 3 | $4.5 \cdot 10^{11}$ |
| + 0.1% treated fibers | 190 | 4 | 3 | $2 \cdot 10^{11}$ |
| (60% polyamide fiber | 100 | 5 | 1 | $3 \cdot 10^{11}$ |
| (40% polyester fiber | 40 | 7 | 0.8 | $3 \cdot 10^{11}$ |
| + 0.2% treated fibers | 45 | 6 | 0.8 | $3 \cdot 10^{11}$ |

As in the preceding examples it is noted that the antistatic properties are far better for the samples containing fibers treated in accordance with the process of the invention than for the sample not containing any and that this improvement increases with the quantity of treated fibers which is introduced.

EXAMPLE 8

In this example the tests described are carried out on samples of carpet identical to those described in Example 7 except that at the time of the coatings the DUROSTAT contained in the latex and in the cellular foam was replaced by an equal quantity of TALLOPOL.

As in Example 7, the results are indicated in the following table (Table 4):

| Sample | Charge density coulomb × $10^{-12}$/ $cm^2$ | Half discharge time in seconds | Walker test coulomb × $10^{-7}$ | Cross-resistance in ohms |
|---|---|---|---|---|
| Control | 1000 | 30 | 5 | $1.5 \cdot 10^{13}$ |
| | 750 | 30 | 3.5 | $1.5 \cdot 10^{13}$ |
| | 700 | 30 | 4.5 | $1.5 \cdot 10^{13}$ |
| (60% polyamide fiber | 130 | 7 | 1 | $3 \cdot 10^{12}$ |
| (40% polyester fiber | 200 | 8 | 2.5 | $2.5 \cdot 10^{12}$ |
| + 0.1% treated fibers | 120 | 6 | 1.5 | $2.5 \cdot 10^{12}$ |
| (60% polyamide fiber | 250 | 7 | 1.5 | $9 \cdot 10^{11}$ |
| (40% polyester fiber | 300 | 6 | 1.5 | $9 \cdot 10^{11}$ |
| + 0.2% treated fibers | 350 | 12 | 1.7 | $1 \cdot 10^{12}$ |

The same remark can be made as above concerning the improvement in the antistatic properties of the carpet with the introduction of fibers treated in accordance with the process of the invention.

What is claimed is:

1. In a process of fixing a copper salt on an article of synthetic polymers wherein the said article is subjected to the action of hydrogen sulfide under a positive gage pressure and then to the action of a copper salt, the method of improving the adhesion of the salt to the article which comprises treating the article with the salt in the presence of at least 0.1 percent by weight of a polyphenol.

2. Process according to claim 1 wherein the polyphenol is included in the salt solution.

3. The process of claim 2 wherein the concentration of polyphenol in the salt solution is between 3 and 6 percent by weight.

4. Process according to claim 1 wherein the article is pretreated with polyphenol before treatment with the salt solution.

5. Process according to claim 1 wherein the polyphenol is diphenol.

6. Process according to claim 1 wherein the polyphenol is 1,3,5-trihydroxy benzene.

7. Process according to claim 1 wherein the polyphenol is a natural or synthetic tannin.

8. Process according to claim 1 wherein the synthetic polymer is a polyamide.

9. Textile articles obtained by the process of claim 1 comprising a uniform, regular, continuous surface deposit of copper salt the thickness of which is between 0.01 and 0.5$\mu$.

10. Textile articles containing at least 0.05 percent by weight of an article obtained in accordance with the process of claim 8.

11. A method of improving the antistatic properties of a synthetic polymer which comprises impregnating the polymer with hydrogen sulfide under pressure and thereafter immersing the resulting product in an aqueous solution containing at least about 0.1 percent of a polyphenol and a copper salt which will react with the hydrogen sulfide to form an electrically conductive deposit on the synthetic polymer.

* * * * *